US006517182B1

(12) United States Patent
Scardovi

(10) Patent No.: US 6,517,182 B1
(45) Date of Patent: Feb. 11, 2003

(54) DROPLET VOLUME CALCULATION METHOD FOR A THERMAL INK JET PRINTER

(75) Inventor: Alessandro Scardovi, Ivrea (IT)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 10/031,379

(22) PCT Filed: Jul. 14, 2000

(86) PCT No.: PCT/IT00/00296

§ 371 (c)(1),
(2), (4) Date: Jan. 18, 2002

(87) PCT Pub. No.: WO01/05594

PCT Pub. Date: Jan. 25, 2001

(30) Foreign Application Priority Data

Jul. 19, 1999 (IT) ..... TO99A0636

(51) Int. Cl.[7] ..... B41J 2/01
(52) U.S. Cl. ..... 347/19
(58) Field of Search ..... 347/7, 14, 17, 347/18, 19

(56) References Cited

U.S. PATENT DOCUMENTS 5,136,305 A * 8/1992 Ims ..... 347/7
5,682,183 A 10/1997 Wade et al. ..... 347/7
5,699,090 A * 12/1997 Wade et al. ..... 347/7
5,721,573 A * 2/1998 Benjamin ..... 347/7
5,767,872 A 6/1998 Scardovi et al. ..... 347/7

FOREIGN PATENT DOCUMENTS

EP 0 749 834 12/1996

* cited by examiner

*Primary Examiner*—Craig Hallacher
(74) *Attorney, Agent, or Firm*—Banner & Witcoff, Ltd.

(57) ABSTRACT

A method for detecting the volume (Vol) of the droplets of ink (22) ejected by a thermal ink jet printhead (11), comprising a continuous driving cycle during which one or more thermal ejection actuators (17) of the printhead (11) are driven in pulsing fashion with a driving energy (Ep) progressively increasing from a condition where no droplets are ejected, while the printhead (11) is maintained at a substantially constant stabilization temperature (Ts), notwithstanding the progressive increase in driving energy (Ep), by means of a heat control member (28) which absorbs and dissipates an appropriate feedback energy. (Er) in the printhead (11); wherein the quantities, correlated to each other in the course of the continuous driving cycle, of respectively the driving energy (Ep) fed to the ejection actuator (17) and the feedback energy (Er) absorbed and dissipated by the heat control member (28), to maintain the printhead (11) at the stabilization temperature (Ts), are acquired for the purpose of defining an experimental characteristic (50) representative of the continuous driving cycle, and in which the two linear end portions (51, 53) of this characteristic (50) are compared with each other in order to calculate, on the basis of their reciprocal deviation (ΔEp), the volume (Vol) of the droplets of ink (22) ejected by the ink jet printhead (11).

17 Claims, 4 Drawing Sheets

DROPLET VOLUME CALCULATION METHOD FOR A THERMAL INK JET PRINTER

FIELD OF THE INVENTION

This invention relates to a method for detecting the volume of the droplets of ink ejected by a thermal ink jet printhead and to an ink jet printer, operating in accordance with said method, having the ability to automatically set optimal printing modes.

TECHNICAL BACKGROUND

At present, both the printers based on ink jet technology and also the printheads used on these printers possess considerable integration between their constituent elements, for the purpose of obtaining the best results in terms of printing quality and operating reliability.

Unfortunately, even with a highly integrated construction and despite various manufacturing stratagems, ink jet printers and relative thermal printheads in actual fact come with dimensional shape errors, albeit minimal, with respect to a nominal condition and also differences from one article to the next, which may impinge, sometimes significantly, on the performances obtained from them and on printing quality in particular.

This drawback is normally due to the errors, tolerances, and dispersion typical of the manufacturing and/or assembly cycle via which the various parts comprising an ink jet printer and relative printheads are made and assembled.

This is especially true of the ink jet printhead arranged for ejecting the droplets of ink in each printer, which is constructed in a very complex manufacturing process consisting of numerous steps and the integration of many components.

In addition, extremely stringent economic criteria which must be satisfied by most of the currently marketed ink jet head models, particularly the "disposable" ones, do not for cost reasons allow each printhead produced to be checked individually, nor any deviation found of the printheads from a nominal condition to be eliminated.

Likewise, the taking of action through continuous adjustments of the printhead manufacturing cycle is almost impossible so that in the final analysis the latter, in actual fact, always come with a certain range of dispersion, even if normally accepted, of their characteristics and in particular of their dimensional parameters.

In general, the factors that may condition, as a result of errors with respect to the nominal conditions and/or of reciprocal interactions, both the reliability and also the final print quality obtainable with an ink jet printer, are numerous, and some of these are listed below for clarity's sake:

- the firmware resident on the ink jet printer, namely the special program for each printer model, which is adapted to manage some basic operations during printing and which in particular defines the timing of the ink jet head driving;
- the ink jet head driving circuit, namely the circuit intended for directly controlling the printhead by supplying it the energy necessary for ejecting the droplets, and which typically comprises a power supply and a plurality of driving components, arranged on board both the printer and the printhead;
- the volume of the droplets ejected by the head, which determines the size of the printed dot;
- the printer driver, namely the program, normally installed on the computer connected to the printer and cooperating with the firmware resident on the latter, which processes the original image, dot by dot, in order to convert its chromatic data into correct commands for the printer, so that the latter performs printing of the original image on a print medium, such as a sheet of paper. In particular, the printer driver operates on the chromatic data of the image depending on various parameters, among which the size of the elementary dot of the image to be printed, the type of print medium, etc., and incorporates suitable algorithms of diffusion of the graphic errors so as to optimally control the printer and accordingly obtain the best print quality.

The general concept of keeping the volume of the droplets ejected by a thermal ink jet printhead under control, in order to improve the performances and final print quality obtainable with the printhead, has been known in the sector art for some time.

For example, the U.S. Pat. No. 5,036,337 describes a method intended for maintaining the volume of the droplets ejected by a thermal ink jet printhead in accordance with a desired value over time.

In this method, an indicative table of reference of the performances obtainable with the ink jet printhead is predefined in advance in empirical fashion, by way of experimental surveys carried out on a wide range of thermal ink jet printheads produced, so as to take into account the tolerances and dispersions typical of their manufacturing process. The reference table is then polled during the printing step so as to condition, through a control circuit, the times and characteristics of the pulses that drive the actuating resistors of the printhead to determine ejection of the droplets.

This method is limited by being based on numerical reference data that are fixed and defined a priori, instead of information continuously updated in real time, indicative of the actual progress of the printing process.

A method is also known from the U.S. Pat. No. 5,767,872 filed on behalf of the Applicant for automatically setting the optimal energetic working point of a thermal ink jet head, that is to say the optimal value for the driving energy to be sent to the ejection resistors of the printhead in order to guarantee a stable ejection of droplets, with a substantially constant volume. This method comprises a test starting cycle during which the ejection resistors of the ink jet printhead are driven with a variable driving energy, for the purpose of experimentally detecting a critical value for the driving energy corresponding to an operating condition of the printhead on the borderline between a zone of unstable emission, at variable volume, of the droplets, and that of stable emission, at a substantially constant volume, of the droplets.

The method then calculates and sets automatically, on the basis of the critical driving energy value detected previously and in particular by incrementing this critical value according to a predetermined percentage, an optimal value for the driving energy with which to drive the resistors in nominal operation. In this way, a nominal operation of each printhead is guaranteed that is undoubtedly inside the zone of stable emission of the droplets, despite the manufacturing tolerances and the lack of precision of the different printheads.

The method has the distinct advantage of giving an effective and automatic setting for each thermal ink jet printhead, making allowance for manufacturing tolerances, in such a way as to permanently obtain a stable emission of droplets; however, it also has the drawback of ignoring, at least in part, the importance of the parameter that is the actual volume of the droplets of ink ejected for constantly guaranteeing optimal print quality. Besides, in particular, this method gives no indication as to how this actual volume of droplets ejected can be determined.

Another known method, disclosed by document U.S. Pat. No. 5,682,183 and provided for determining imminent ink exhaustion in a thermal inkjet print cartridge, is based on the discovery that ink drop volume falls at a faster rate at high frequency firing rates than at low frequency firing rates, as ink supply diminishes. The method includes warming the print cartridge printed and ink to a predetermined temperature; then operating the print cartridge printed at a first firing frequency to eject a volume of ink, said operating step including heating the ink and printed, carrying away heat in the ejected volume of ink, and conveying a volume of cooler ink to the printed to replace the ejected volume; and monitoring a first temperature change from the predetermined temperature. Then warming the same print cartridge printed and ink to a predetermined temperature; operating the print cartridge printed at a second firing frequency which is different than the first firing frequency to eject a volume of ink in the form of droplets, said operating step including heating the ink and printed, carrying away heat in the ejected volume of ink, and conveying a volume of cooler ink to the printed to replace the ejected volume; and monitoring a second temperature change from the predetermined temperature. The first and second temperature changes are compared to indicate a low ink supply. However also this method is not capable of giving indication as to how the actual volume of the ejected droplets can be determined.

SUMMARY OF THE INVENTION

The primary object of this invention is to define a method for detecting in a sufficiently reliable and precise way the actual volume of the droplets ejected by a thermal ink jet printhead, in order to permit a more effective control and use of this important parameter in ink jet printing.

Another object of this invention is to define a method permitting to significantly improve the performances, particularly printing quality, obtainable from a printer provided with an ink jet printhead, based on detection of the volume of the droplets of ink ejected by the ink jet printhead.

The above objects may be attained by means of a method and device for automatically detecting the volume of the droplets ejected by a thermal ink jet head, having respectively the steps and characteristics defined in the main independent claims.

In particular, according to what is demonstrated by this invention, the detection of the volume of the droplets ejected by a thermal ink jet printhead is used to set automatically, i.e. without any intervention from a user, the printing modes during operation of the printer in which the printhead is fitted, so as to constantly optimize the printing quality obtained.

BRIEF DESCRIPTION OF THE DRAWINGS

These and other objects, characteristics and advantages of the invention will become apparent in the description that follows of a preferred embodiment, provided by way of a non-restrictive example, with reference to the accompanying drawings.

PREFERRED MODE FOR CARRYING OUT THE INVENTION

Figure 1:
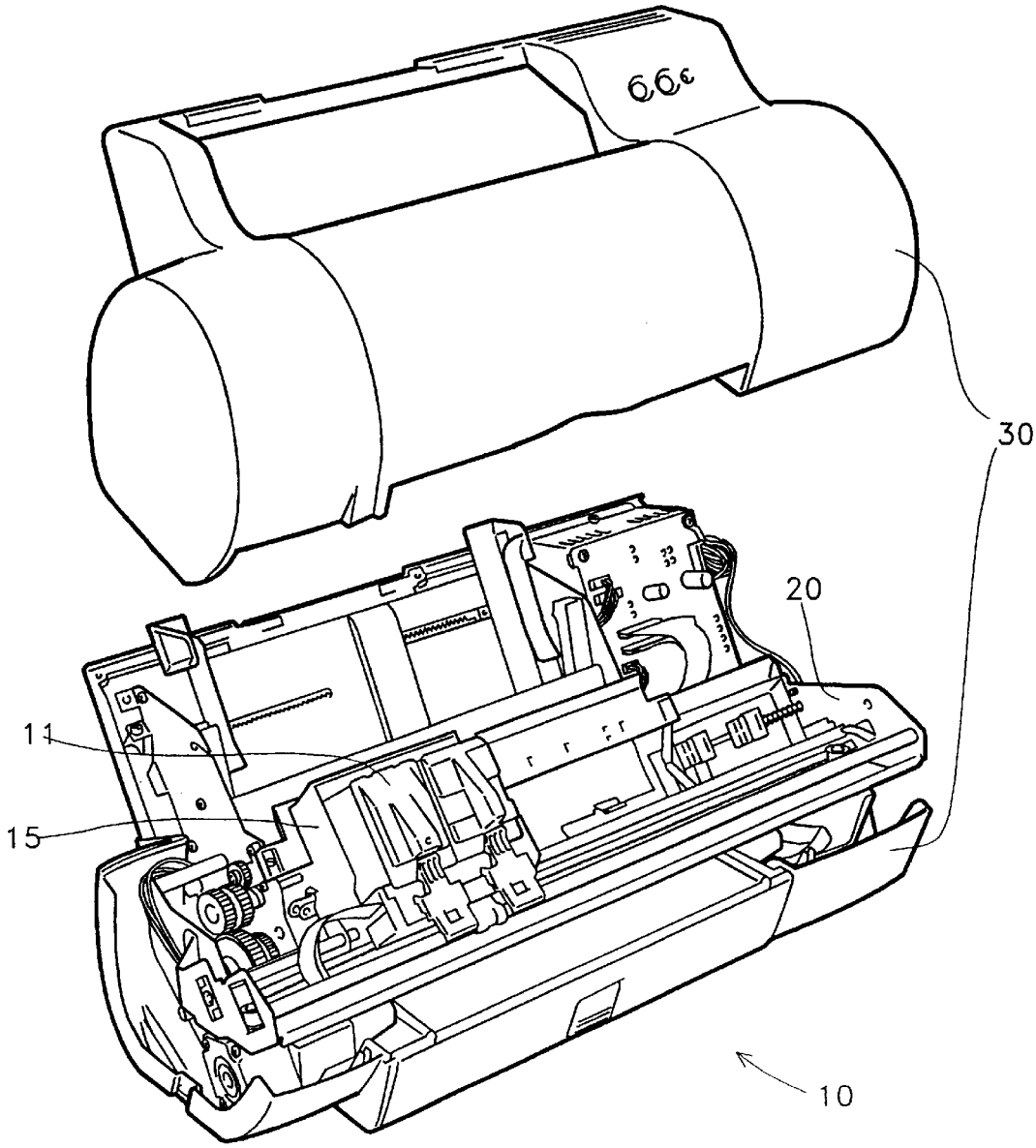
FIG. 1 is an enlarged perspective, schematic view of an ink jet printer operating according to the method of the invention.

With reference to FIG. 1, an ink jet printer, suitable for working in accordance with method of this invention for detecting the volume of the droplets ejected, is generically designated with the numeral 10, and comprises a fixed structure 20; an outer casing 30, represented in enlarged form, which protects the fixed structure 20 extermally; a carriage 15 movable with respect to the fixed structure 20; and an ink jet printhead 11 fitted removably on the carriage 15 and having the ability to eject droplets of ink.

The printhead 11, when it is fitted on the carriage 15, faces by a front part a print medium, not depicted in FIG. 1 and consisting of, for example, a sheet of paper, which is arranged to be moved by appropriate members of the printer 10.

The carriage 15 in turn is suitable for moving with respect to the fixed structure of the printer 10, in order to move the printhead 11 alternatively backward and forward in front of the print medium, while the printhead 11 ejects the droplets of ink on the latter.

Ejection of the droplets is controlled by a suitable control circuit accommodated inside the printer 10, in order to form symbols, characters and images on the print medium, as the summation of dots printed corresponding to the droplets ejected. The printhead 11 is suitable for operating on the basis of the technology known as thermal ink jet printing, occasionally also called bubble ink jet printing technology, wherein the ink contained in the printhead 11 is brought to boiling point in order to produce, inside the ink, the occurrence of a bubble of vapour which, by expanding, causes the ejection of the droplets through a plurality of nozzles of the printhead 11.

The printhead 11 may contain black ink only, permitting printing in black and white only, or one or more coloured inks, permitting colour printing, in accordance with the various solutions currently and widely adopted in the field of printers and corresponding ink jet printheads.

Figure 2:
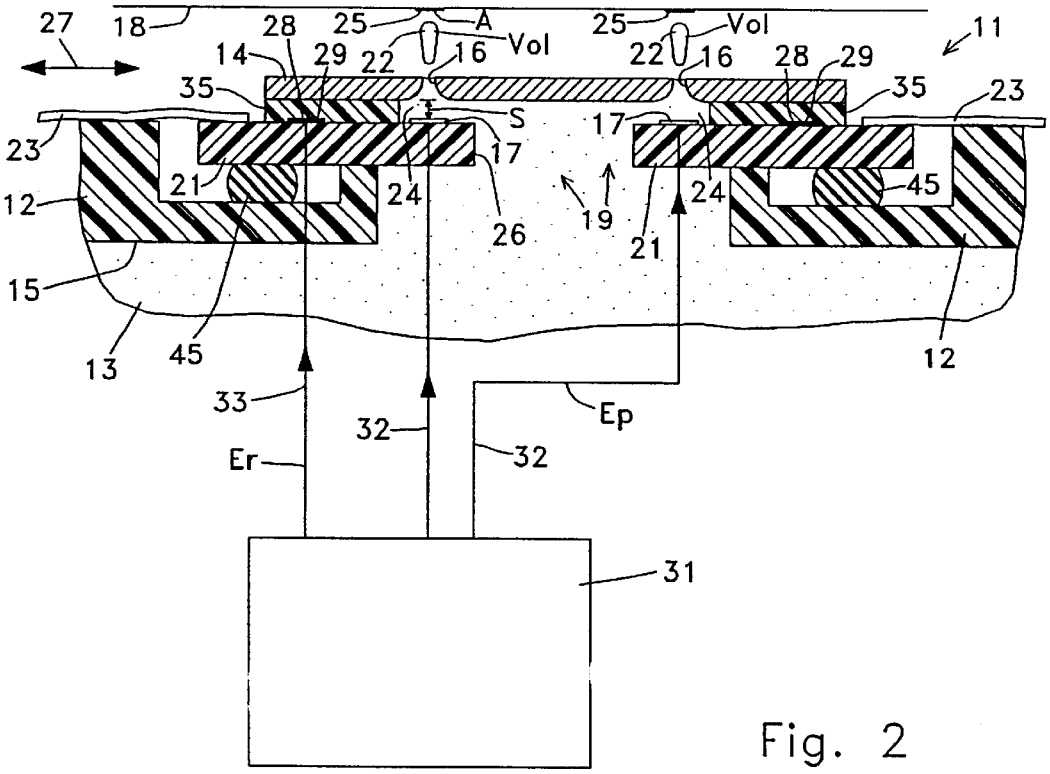
FIG. 2 shows an enlarged scale section of the front part, where the ejection of the droplets of ink is effected, of an ink jet printhead fitted in the printer of FIG. 1.

The internal details of the printhead 11 can be seen in FIG. 2 which represents, in section, the front part of the printhead 11 arranged in front of the print medium. The latter is designated with the numeral 18 and typically consists of a sheet of paper.

In particular the printhead 11 comprises an outer shell 12, generally of a plastic material, which defines on the inside a tank 15 for a reserve 13 of ink; a plate 14, provided with a plurality of nozzles 16 and for this reason also called nozzles plate, which is facing the print medium 18; a plurality of ejection actuators 17 each of which is associated with a respective nozzle 16 for activating the ejection, by the latter, of droplets of ink 22 towards the print medium 18; a substrate 21, also called "die" and made of a semiconductor type material such as silicon, bearing on its surface the ejection actuators 17; a layer 35, made of a material such as a photopolymer, through which the nozzles plate 14 is attached to the substrate 21; and a hydraulic circuit, indicated generically with the numeral 19, the function of which is essentially to convey the ink from the reserve 13 to the area of the ejection actuators 17, so that the ink may come against the latter and accordingly be brought to boiling point to cause the ejection of the droplets 22, as will be better explained below.

Further a control unit 31, represented schematically in FIG. 2 and described in greater detail below, is arranged for controlling operation of the printhead 11, and for this purpose is electrically connected to each of the ejection actuators 17 via a plurality of lines 32.

The hydraulic circuit 19 comprises a central opening or slot 26 which puts the tank 15 in communication with the zone of the ejection actuators 17 and of the nozzles 16, and also a plurality of channels and chambers, mostly not shown in FIG. 2, which are intercommunicating and have the function, as already stated, of bringing the flow of ink to come against each ejection actuator 17. These channels and chambers are mainly made in the layer 35 of photopolymer and extend along a plane perpendicular to that of FIG. 2.

In particular, the hydraulic circuit 19 in correspondence with each ejection actuator 17, between the nozzles plate 14 and the substrate 21, forms a chamber 24, having a thickness S of very low value, which is filled with the ink coming from the reserve 13.

The substrate 21 is attached to the shell 12 with the aid of a glue or filler material indicated with the numeral 45, so as to form a hermetic seal for the tank 15.

The substrate 21, the ejection actuators 17 disposed on the substrate 21, the connecting circuit and tracks associated with the actuators 17, together with other components described later, are produced in a production cycle, based on the semiconductor technology, through which a high degree of miniaturization of the components produced may be obtained, as required by the structure of ink jet printheads.

The ejection actuators 17 are disposed along the substrate 21 in front of the respective nozzles 16, and are separated from the latter by a thin layer of ink determined by the chamber 24.

Again, the ejection actuators 17 and corresponding nozzles 16 are disposed according to widely known configurations, for example in various rows suitably distanced one from the other. By way of example, FIG. 2 refers to the case in which the nozzles 16 and the actuators 17 are grouped in two rows disposed in the direction normal to the direction of movement, indicated by the arrow 27, of the printhead 11 with respect to the print medium 18.

The ejection actuators 17 are intended for being selectively driven by suitable electric signals, generated by the control unit 31 and explained in greater detail below, which reach the ejection actuators 17 through the lines 32.

Indicated in FIG. 2 by arrows along the lines 32, these signals have the purpose of activating the ejection actuators 17 in order to cause ejection of the droplets of ink 22.

The end portion of the lines 32, integral with the head 11, is made of flat cables 23 which extend on the outer surface of the shell 12, and which at one end are electrically connected to the different ejection actuators 17, and at another end, not depicted in the drawings, are provided with conductive contact pads suitable for coming into contact, when the printhead 11 is mounted on the carriage 15 of the printer 10, with corresponding contacts, again not depicted in the drawings, accommodated in the movable carriage 15.

In this way, the printhead 11, when it is mounted on the carriage 15, is connected electrically to the control unit 31, and can thus receive the relative signals arranged for commanding the printhead 11 during its transversal motion in front of the print medium 18.

The electronic control unit 31 typically comprises a microprocessor and is made of components that can be located either on board the printhead 11, and therefore move with the latter, or in the fixed structure 20 of the printer 10, without this having any impact whatsoever on the characteristics of the invention.

The control unit 31 also performs the task of permitting the exchange between the printer 10 and the other parts of the system in which the printer 10 is inserted.

At this juncture, it is worth remembering that the printer 10 is rarely arranged for operating alone, but is normally inserted in a system, consisting of a computer, in which the printer 10 operates as an output device, generally for printing data processed by the computer.

In this system the computer-resident programs, intended for processing the data, exchange with the control unit 31 of the printer 10 through the support of a specific program, sometimes called "printer drivers", which is generally installed in the computer, the function of which is to convert the data processed by the computer into suitable commands for the printer 10, so that the data may be printed. Normally the printer driver is specific to each type of ink jet printer, as it must, in particular, take account of how the relative printhead(s) is or are structured and of its or their functional characteristics.

In turn, the printer driver is provided for cooperating with a program, also called "firmware" and normally loaded in the control unit 31 when the printer 10 is manufactured, for the purpose of outputting the actual printing pulses transiting on lines 32 towards the ejection actuators 17, and therefore of effecting printing of the data processed by the computer on the print medium 18.

In particular, the ejection actuators 17 are operatively comparable to resistors, which are suitable for receiving from the control unit 31 on the lines 32 a driving energy Ep in pulse form, in which each pulse of the driving energy Ep corresponds to a dot to be printed, and which are also suitable for converting the pulse received into heat, through Joule effect.

The heat thus generated is, in turn, dissipated into the ink brushing against the ejection actuators 17, determining, in the immediate vicinity of each ejection actuator 17, the generation of an ink vapour bubble which, by expanding, pushes the ink contained in the chamber 24 through the respective nozzle 16, so that the ink is ejected to the outside in the form of droplets 22.

Figure 4:
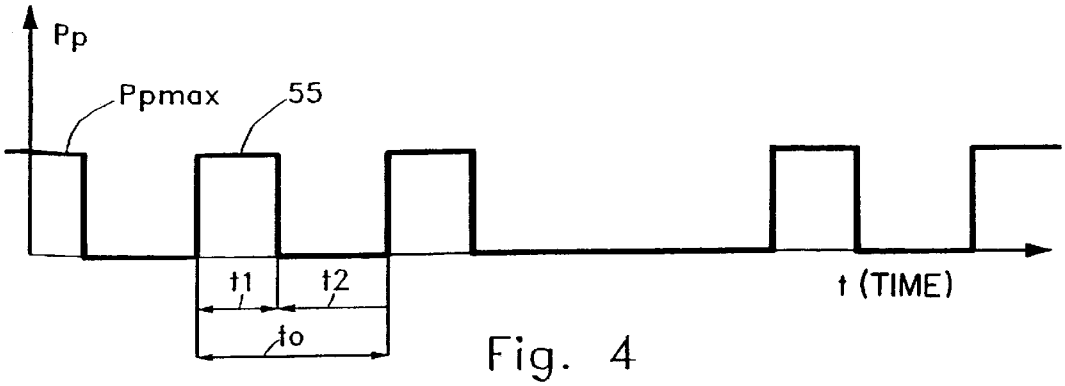
FIG. 4 is a second, timing type diagram, illustrating the driving power signal that commands the thermal ejection actuators of the printhead of FIG. 2 to cause ejection of the droplets.

The driving energy Ep corresponds to a driving power Pp which is supplied by the control unit 31 to the ejection actuators 17 in accordance with a signal 55 having over time t a pulse pattern, represented in qualitative terms in the diagram of FIG. 4.

As can be seen, the signal 55 comprises a series of cycles, wherein each cycle has an overall duration to, which is in turn subdivided into a first time interval t1, during which the driving power Pp assumes a maximum value Ppmax, and a successive second time interval t2, during which the driving power Pp is practically null.

Each single cycle of the signal 55 of duration to causes a rapid heating, followed by a rapid cooling, of the ejection actuator 17, and this results in, as already said, the formation of an ink vapour bubble and the subsequent rapid bursting thereof, so that each cycle corresponds to the emission of one droplet 22.

Naturally, the sequence of the power or energy cycles on the signal 55 is determined by the printer driver in collaboration with the firmware of the printer 10 depending on the specific information to be printed, that is to say on the corresponding characters and graphic symbols that have to be printed on the print medium 18.

The cycles of the signal 55 are activated synchronously with the movement of the head 11 in front of the print medium 18, and can reach a maximum frequency, corresponding to the maximum number of cycles of duration to in the unit of time, which is determined by the typical characteristics of the printhead 11 and is generally sufficient to allow the correct ejection of two successive droplets without any overlap between the respective cycles of ink vapour bubble formation, expansion and bursting.

Different cyclical patterns, though in all cases adapted for generating bubbles, are possible for the driving power signal Pp, according to widely applied arrangements and criteria.

Incidentally, it is pointed out that, as it is known that power is defined as the energy delivered per unit of time, there is a direct correspondence between the driving energy Ep and the driving power Pp supplied to each ejection actuator 17.

It is therefore obvious that these two quantities, the driving power Pp and the driving energy Ep, can be used in an equivalent way in the context of this description, so that the fact of referring to one or the other of the quantities is merely a matter of preference.

In particular, the driving energy Ep absorbed by a generic ejection actuator 17 during a pre-established period of time, of sufficient length to include numerous cycles of duration to of the signal 55, is indicative of the average power delivered to the generic ejection actuator 17.

As is clear from observing the periodic pattern of the signal 55, in order to vary the value of the driving energy Ep delivered in the unit of time to a generic ejection actuator 17, it is sufficient to modify the ratio between the time t2 and the time t1 in the periodic signal, namely the parameter known to those acquainted with the sector art as the "duty cycle".

The printhead 11 also comprises a temperature sensor 28 connected to the control unit 31 and having the function of transmitting the latter a signal indicative of the temperature inside the printhead 11. Preferably the sensor 28 is arranged adjacent to the silicon substrate 21, on the face bearing the various ejection actuators 17.

In this way, thanks to the good heat conduction properties of the silicon substrate 21, the temperature detected by the sensor 28 is indicative of the actual thermal conditions inside the printhead 11 during its operation, in particular in the zone where the ejection actuators 17 are subject to being heated and cooled periodically to cause ejection of the droplets 22.

The temperature sensor 28 may be made in various ways, in terms of both material and shape. For example, it may be made of a resistor having a resistance variable with temperature, and may also be dot-like, or at any rate be of limited size, to emit a temperature signal indicative of the temperature in a precise, delimited area of the printhead 11.

Or alternatively, the temperature sensor 28 may be of elongated shape, typically in a serpentine, running along the substrate 21, in order to generate a signal indicative of the average temperature along a fairly wide area of the printhead 11.

In particular, in the representation of FIG. 2, the temperature sensor 28 is supposed to have an elongated shape that is developed around the rows of ejection actuators 17, so that it appears in section at two opposite ends with respect to the zone of the ejection actuators 17.

The printhead 11 also comprises a heat control member 29 connected to the control unit 31 and provided for being conditioned, according to known methods, by the temperature detected by the sensor 28, so as to keep constantly under control and stabilize over time the thermal conditions inside the printhead 11, and in particular to keep the latter at a predetermined constant temperature, also called stabilization temperature Ts. In this way, the temperature sensor 28, the heat control member 29, and the control unit 31 constitute the typical components of a feedback type heat control system, having the ability to keep the temperature of the printhead 11 constantly under control while operating, and in particular is capable of intervening rapidly and automatically in order to re-establish the stabilization temperature Ts in the printhead 11, following any deviation therefrom.

To this end, the control element 29 is typically made of a resistor intended for absorbing a feedback electrical energy Er, and for dissipating it through joule effect into heat in the printhead 11.

As with the driving energy Ep, the feedback energy Er is normally supplied to the heat control member 29 not with a continuous signal, but a discrete one, formed of a succession of cycles, each of which comprising a time interval during which the signal is high and accordingly the feedback energy Er is effectively supplied to the heat control member 29, and a time interval during which the signal is low or null and there is therefore no absorption of feedback energy Er by the control member 29.

In particular, as already stated in relation to the periodic signal 55 of the driving power Pp supplied to the ejection actuators 17, it is possible to change the feedback energy Er delivered per unit of time to the heat control member 29, by altering the ratio, in each cycle of the periodic signal of the feedback energy Er, between the durations of the two time intervals in which the signal is respectively high and low, i.e. the parameter known as the "duty cycle".

In the preferred embodiment described and represented herein, the temperature sensor 28 and the heat control member 29 are materially one and the same entity, in the sense that they are physically made of a single resistor, which is used alternatively as a heater for generating by joule effect heat to be transmitted to the surrounding atmosphere, and as a sensor to permit the reading of temperature on the basis of the change in resistance of the resistor.

Naturally it is also possible to make the temperature sensor 28 and the heat control member 29 separately while remaining within the scope of the invention.

The control unit 31, suitable for controlling the operation of the printhead 11, as well as to the ejection actuators 17, is also connected to the temperature sensor 28, and therefore also to the heat control member 29, through a line 33.

In practice, as already said, the control unit 31, while the printhead 11 moves in front of the print medium 18, commands the ejection of the droplets 22 by sending pulses to the ejection actuators 17 according to a suitable sequence, so that the droplets 22 ejected by the nozzles 16 form the characters and images desired on the print medium 11.

In particular each droplet 22 ejected by the printhead 11 corresponds to a printed dot 25 on the sheet 18, so that it will be readily understood how the area A of the printed dot 25 is strictly dependent on the volume Vol of the single droplet of ink 22.

The printhead 11 is designed to produce a determined nominal dimension of the dot 25, upon which is based the printing process that is effected by the printer 10 to obtain correct coverage of the document in relation to the printing definition set on the printer 10. In particular, depending on the nominal dimension of the dot 25, the printer driver operates with its calibration algorithms in order to give a correct saturation, distribution and overlap on the document of the various dots printed.

In manufacture, however, it is impossible to build printheads 11 capable of obtaining on the sheet of paper 18 a dot 25 of size that is always constant and equal to the nominal value, because many parameters and quantities of the printhead 11 have intrinsic manufacturing tolerances and are also subject to change with time.

By way of example, among these parameters, we can quote the diameter of the nobles and the area of the resistors which, with their variations, have a considerable influence on the volume dimension of the droplet 22.

The manufacturing dispersion of certain parameters of the printheads may also be considerable (±10÷15%), and the tendency is for this to increase as printing technology demands ever higher definitions, requiring the use of extremely small droplets.

It is easy to deduce in fact that, with the reduction of the manufacturing dimensions of the ink jet printheads dictated by the need to obtain droplets of increasingly smaller diameter, the incidence in percentage terms of manufacturing dispersion of the printheads produced tend tends to increase correspondingly; likewise, the difficulty of maintaining this dispersion at an acceptable level.

Figure 3:
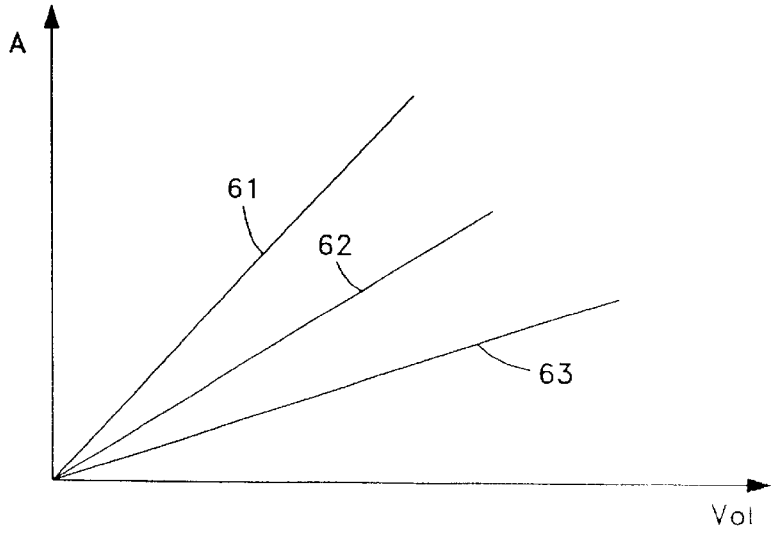
FIG. 3 is a first diagram illustrating the relationship between the volume of the droplets ejected by the printhead of FIG. 2 and the area of the dots printed on a print medium.

For clarity's sake, the diagram of FIG. 3 shows three straight lines 61, 62 and 63 which define qualitatively the ratio between the volume Vol of the droplets ejected 22 and the area A of the printed dot 25, wherein each of the straight lines refers to a specific combination between print medium, ink and printhead type.

As may be seen, whatever the combination adopted, the ratio assumes a linear pattern, so that the area A tends to increase in direct proportion to the volume Vol. Again, for a given volume Vol of the droplets ejected, the area A depends on the particular combination selected, in particular between the type of paper and the type of ink. The diagram of FIG. 3 also demonstrates how even small percentage variations of the volume Vol are capable of producing sizeable variations of the area A, and therefore of the optical density of the dots printed.

The reason for this ratio assuming a linear pattern may easily be deduced, if one thinks of how the phenomenon of deposition of the droplets on special, surface-treated print media occurs, wherein the droplet substantially penetrates only into the surface layer of the print medium, i.e. into that which is sometimes called the "coating", and defines a cylinder of constant thickness having an exposed area that is proportional to the volume Vol of the droplet.

Therefore the variations of volume of the droplets may cause considerable optical density variations, especially in the intermediate tones, that may even be of 30%.

As is known, bubble type thermal ink jet printheads have an operating characteristic of ejection of the droplets, namely an experimental relationship between the volume Vol of the droplets ejected and the driving energy Ep delivered to the ejection actuators, which has a clearly identifiable pattern, typical of this category of printheads.

This experimental relationship is represented by means of the curve 40 in the diagram of FIG. 3, where the values of the driving energy Ep delivered to a generic ejection actuator during each ejection cycle are indicated on the x-axis, and the corresponding values of the volume Vol of the droplet ejected by the nozzle associated with the ejection actuator are indicated on the y-axis.

The diagram of FIG. 3 has an essentially qualitative value, and does not give quantitative and numerical indications about the volume Vol and the driving energy Ep. It must be pointed out however, to give the full picture, that in the context of thermal ink jet printing technology that this invention belongs to, the volume Vol of each droplet ejected assumes values that are of the order of magnitude of picolitres (pl), while the corresponding driving energy Ep is delivered in quantities having an order of magnitude of microjoules ($\mu$J)

In greater detail, the curve 40 presents a first threshold value Eps of the driving energy Ep, below which the volume Vol is null, i.e. no ejection of droplets takes place; an inclined portion 41 along which the ejection of droplets does occur, even if not in a stable way, with the volume Vol of the droplets progressively increasing in relation to the driving energy Ep; a knee zone 42, corresponding to a knee value Epg of the driving energy Ep, which delimits the inclined section 41 at the top end, and along which the volume Vol of the droplets ejected ceases to increase; and finally a substantially flat section 43 along which the droplets are emitted stably, with a substantially constant volume in spite of the increasing driving energy Ep.

The nominal value Epn of the driving energy Ep is normally set in such a way that it corresponds to a central zone of the flat section 43 of the curve 40, thereby guaranteeing that the emission of droplets is not only stable but also sufficiently removed from the critical zone which is that corresponding to the knee 42 of the curve 40.

Indicatively the threshold Eps, knee Epg, and nominal Epn values of the driving energy correspond to ejection actuator temperatures equal to respectively 320° C., 350° C. and 450° C.

The method of the invention has, as already stated, the object of determining with good precision the actual volume of the droplets of ink 22 ejected by the printhead 11, and offers several considerable analogies with the method, described in the above-mentioned U.S. Pat. No. 5,767,872 filed by the Applicant, intended for automatically setting the energetic working point of a thermal ink jet printhead.

In fact, the present method also envisages, to begin with, a continuous driving cycle during which one or more ejection actuators 17 are driven with a quantity of the driving energy Ep that is progressively variable, for example increasing, starting from an initial quantity of the driving energy Ep significantly lower than that needed to cause ejection of the droplets of ink, before the driving energy Ep is increased so that the printhead 11 moves gradually from the condition of non-ejection of the droplets to a condition of stable ejection of the droplets of ink 22.

In detail, this continuous driving cycle, on account of the progressive increase of the quantity of driving energy Ep, evolves through three steps: respectively a first step, called at low driving energy, during which the driving energy Ep delivered to the ejection actuators 17, though increasing, does not reach a sufficient level to activate ejection of the droplets 22; a second intermediate step, during which the printhead 11 ejects droplets of ink presenting unstable characteristics, that is to say droplets having a volume varying depending on the quantity of driving energy delivered to the ejection actuators 17; and finally a third step, called at high driving energy, during which the printhead 11 on the other hand ejects droplets of ink with characteristics of stability, that is to say droplets having a substantially constant volume despite variation of the quantity of driving energy Ep delivered to the ejection actuators 17.

During the entire evolution of this continuous driving cycle the printhead 11 is maintained at a substantially constant stabilization temperature Ts, for example of approximately 40÷50° C., in particular in correspondence with the surface of the substrate 21 on which the ejection actuators 17 are disposed, through the feedback type heat control system based on the temperature sensor 28 and on the heat control member 28.

To this end, the resistor, constituting both the temperature sensor 28 and the control member 29, works alternatively as a sensor and a heater, sending the control unit 31 during a first step a signal indicative of the temperature of the printhead 11, and then dissipating in the printhead 11, during a subsequent second step, a quantity of heat proportional to the feedback energy Er received from the control unit 31 and dependent on the temperature detected in the previous step.

As already stated, the amount of heat generated by the heat control member 29 for dissipation in the printhead 11, is adjusted by altering the duration of the pulses constituting the feedback energy Er signal.

The stabilization temperature Ts may be set in various ways. For example, it may be established a priori, once and for all; or it may be set at the start of each driving cycle, in relation to the ambient temperature in the immediate surroundings of the printhead 11.

In particular, according to a highly advantageous arrangement, as will be better understood below, the stabilization temperature Ts is obtained by detecting the value of the ambient temperature and increasing the value thus detected according to a predefined quantity, for example 25° C., so that the stabilization temperature Ts always corresponds to a fixed overtemperature with respect to the ambient temperature.

Throughout the course of the driving cycle, all the ejection actuators 17, or at least some of them, are driven with a pulse signal of driving energy Ep having a fixed frequency, indicatively between 500 and 1000 Hz, whereas the duration, or width, of each pulse of the signal is progressively increased starting, as already said, from a value lower than that needed to determine ejection of the droplets.

The progressive increase of the driving energy Ep pulse width is brought about in small percentage increments, of 1÷2%, to give a certain gradual nature to the variations of the driving energy Ep occurring while the driving cycle is in progress.

In this way, the printhead 11 which, it will be remembered, has a thermal response that is not instantaneous but rather conditioned by internal thermal constants dependent on the structure of the printhead itself, has enough time to comfortably adjust its thermal conditions following each variation of the driving energy.

Besides, in this way, the values of the driving energy Ep and of the feedback energy Er, which are correlated to each other to maintain the printhead 11 at the stabilization temperature Ts, may be detected with good precision, during the entire course of the driving cycle.

It is clear that, in the course of the continuous driving cycle, the heat control system arranged in the printhead 11 sees to it that the variations of the quantity of heat dissipated in the printhead 11 by means of the ejection actuators 17, on account of the progressive increase of the driving energy Ep, are compensated for by corresponding variations of the quantity of heat dissipated in the printhead 11 through the heat control member 28, in order to maintain the temperature of the printhead 11 constant in time.

As will be seen more fully in the following, throughout the course of the continuous driving cycle, with the exception of the intermediate step of unstable ejection of the droplets 22, an increment of the quantity of driving energy Ep supplied per unit of time to the ejection actuators 17 determines a corresponding decrease of the quantity of feedback energy Er supplied to the control member 28 during the same unit of time.

To better appreciate the characteristics and the exact development of the continuous driving cycle described above, it is shown in the diagram of FIG. 6 where the x-axis indicates the progressively increasing quantities of driving energy Ep delivered to the ejection actuators 17, and the y-axis the correlated quantities of feedback energy Er, delivered to the heat control member 28, to maintain the printhead constantly at the stabilization temperature Ts all through the driving cycle.

In this way, a characteristic 50 is obtained which accordingly defines the experimental relationship which links, in the course of this continuous driving cycle, the quantities of driving energy Ep and of feedback energy Er, delivered per unit of time.

Figure 6:
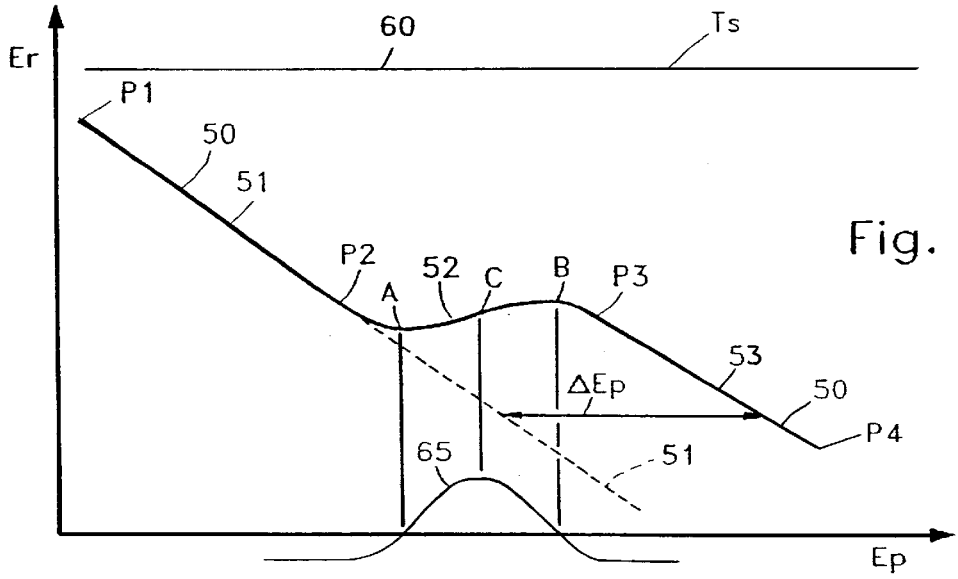
FIG. 6 is a fourth diagram that represents the progress of a continuous driving cycle envisaged by the method of the invention, during which a progressively increasing driving energy Ep is supplied to the ejection actuators of the printhead of FIG. 2, and correspondingly a feedback energy Er is dissipated in the printhead to keep it constantly at a substantially constant stabilization temperature Ts.

Clearly, since the ejection nozzles 17 are driven with a pulse signal of constant width Ppmax and a progressively increasing pulse duration t1, the times that define the duration of these pulses correspond to the values of the driving energy Ep and therefore can be indicated on the x-axis, in place of the latter-named, in the diagram of FIG.6.

Similarly, when the feedback energy Er is delivered through a feedback power signal Pr having a pulse pattern, on the y-axis the values of the feedback energy Er may correspond to and therefore be indicated by the times of the pulses constituting the feedback power pulse signal Er.

For the sake of completeness, the diagram of FIG. 6 at the top also has a line 60 relative to the stabilization temperature Ts of the printhead 11, and therefore having a horizontal pattern to indicate that the stabilization temperature Ts does not change, despite the progressive increase of the driving energy Ep.

The method of the invention envisages that, in the course of this driving cycle, the various correlated quantities, respectively of the driving energy Ep and of the feedback energy Er, which define the characteristic 50 and which allow the head 11 to be maintained at the stabilization temperature Ts, be acquired and stored in a memory of the control unit 31.

In detail, the characteristic 50 has a first rectilinear section or portion 51, of constant slope and extending between the points P1 and P2. This section 51 corresponds to the starting step, at low driving energy, during which the driving energy Ep is unable to cause ejection of the droplets 22, and is therefore below the threshold needed to trigger boiling of the ink Along the section 51, the driving energy Ep and the feedback energy Er, both being able to dissipate heat and therefore heat the printhead 11, contribute with respective substantially equivalent, though of opposite sign, quantities, to maintaining the temperature of the printhead 11 constant This can be easily understood when we remember that, if on the one hand the development of the driving cycle implies an increase in the driving energy Ep supplied in the unit of time, on the other hand the heat control system of the printhead 11 reacts automatically to this increase by decreasing the feedback energy Er delivered in the same unit of time.

Therefore the quantities of the driving energy Ep and of the feedback energy Er which are supplied mean that initially the characteristic 50 follows a downward line in correspondence with the portion 51, until ejection of the droplets 22 occurs, corresponding to the point where the characteristic 50 abandons its linear pattern.

Similarly it is easy to understand that, if the ejection of droplets were to be impeded by force even after the threshold driving energy Eps is reached, for example by blocking the nozzles on the outside of the printhead 11, the characteristic 50 would not on this account abandon its linear pattern, but would continue along the section 51', with the same previous incline as the portion 51.

In fact in this hypothetical case, despite boiling of the ink taking place and, that is to say, there being a conversion of energy in the ink contained in the printhead 11, 11 the energy introduced would remain localized inside the printhead 11 without undergoing any subtractions, before finally degrading, after various transformations, into thermal energy, so that the relationship between the driving energy Ep and the feedback energy Er would continue to be linear along the section 51'.

Conversely, when ejection of the droplets 22 occurs, a portion of energy leaves the printhead 11 together with the droplets 22, and this does not allow a linear law to be maintained between the driving energy Ep and the feedback energy Er.

After the section 51, the characteristic 50 presents a curving portion 52, joined to the rectilinear section 51, having a flexed shape and extending from point P2 to point P3, beyond which the characteristic 50 resumes a linear pattern along a portion 53.

This curving portion 52 corresponds to the intermediate step of the driving cycle, at the start of which ejection of the droplets of ink 22 from the nozzles 16 occurs and in the course of which the droplets 22 are ejected unstably with a volume Vol varying in relation to the quantity of driving energy Ep delivered.

The fact that the pattern assumed by the characteristic 50 along the curving portion 52, from point P2 to point P3, is not instantaneous but on the other hand develops along a certain range of variation of the driving energy Ep, depends substantially on the following two reasons.

Firstly, boiling does not occur in all the nozzles at the same value of driving energy Ep, but there is always a certain dispersion, or spread, from one nozzle to the next. Besides, the portions 52 corresponds, as already said, to the starting section 41 of the energy characteristic, represented in FIG. 6, and which shows a rising trend of the volume Vol of the droplets ejected.

Figure 5:
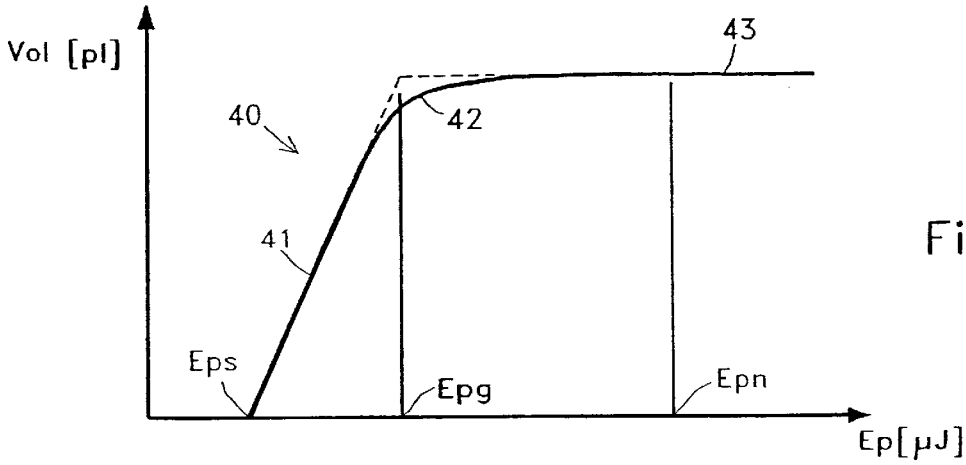
FIG. 5 is a third diagram illustrating how the volume of the droplets ejected by the head of FIG. 2 varies in relation to the driving energy supplied to the relative thermal ejection actuators.

The characteristics of the curving portion 52 may be better analyzed through reference to its derivative, consisting of the curve 65 shown in the diagram of FIG. 5. As can be seen, the section 52 has three characteristic points, two indicated with the letters A and B corresponding to a null value of the derivative 65, and a third indicated with the letter C corresponding to a maximum value of the derivative 65.

These points A, B and C are disposed in correspondence with some typical operating conditions of the printhead 11. In particular, with reference to FIG. 5, the point A corresponds roughly to the threshold energy Eps needed to trigger off the ejection of the droplets, the point B corresponds roughly to the knee energy Epg, whereas the point C corresponds to an intermediate value of the driving energy Ep between the threshold value Eps and the knee value Epg.

Accordingly the derivative 65 lets us determine easily and with good precision the salient points of the curve 40 of FIG. 5, which represents the operating characteristic, typical of each printhead, of ejection of the droplets.

In particular, as already stated, it is possible, starting from the salient points identified along the curve 40, to select correctly and set the optimal energetic working point for the printhead 11, i.e. the optimal value of the driving energy that needs to be delivered to the ejection actuators to obtain a stable ejection of droplets, sufficiently removed from the critical zone of unstable ejection of droplets.

Such a setting of the working point permits to compensate the spread with which printheads are manufactured.

As already stated, beyond the point P3 disposed at the end of the portion 52, the characteristic 50 continues with the portion 53, corresponding to the high driving energy step, assuming again a linear trend having an incline similar to the initial one of section 51.

In this way, the characteristic 50 continues, up to the point P4, substantially parallel to that portion 51', which, as explained earlier, would be obtained if the condition of total absence of ejection of droplets were maintained by force throughout the entire course of the continuous driving cycle. In accordance with the method of the invention, from the characteristic 50 it is possible to obtain information not only in connection with the salient points of the curve 40, i.e. with the operating characteristic of ejection of the droplets typical of each printhead 11, but also other information concerning the volume of the droplets ejected 22.

In particular, after the completion of the continuous driving cycle, in order to obtain the characteristic 50 that defines the experimental law of variation of the feedback energy Er in relation to the driving energy Ep with the printhead 11 maintained at the stabilization temperature Ts, the method of the invention puts in relation the displacement, in the context of the diagram of FIG. 6, between the linear portions 51 and 53 of the characteristic 50 thus acquired, with the phenomenon of ejection of the droplets, in order to obtain from this displacement information about the volume Vol of the droplets 22 ejected by the printhead 11.

More specifically, the two portions 51 and 53 with their respective prolongations are compared with each other to define a term, indicated with ΔEp, indicative of the increase in the quantity of driving energy Ep that needs to be supplied to the ejection actuators 17, for a like dissipated quantity of feedback energy Er, in the transition from the non-ejection step to that of stable ejection of the droplets 22. As may be seen in FIG. 6, this term ΔEp assumes a substantially constant value for each characteristic 50, corresponding to a given printhead 11, and is determined, for instance, by intersecting the end portions 51 and 53 of the characteristic 50 or the respective prolongations with a line parallel to the axis of the abscissas, that of the driving energy Ep.

It should also be noted that, as the two portions 51 and 53 are substantially parallel to each other, the value of the term ΔEp may be determined in correspondence with various levels of the feedback energy Er.

It is considered at any rate preferable to effect determining of the term ΔEp along the central part of the characteristic 50, comprising the intermediate portion 52, and the sections, laterally adjacent thereto, of the portions 51 and 53.

Finally the term ΔEp thus obtained, is processed to obtain information about the volume Vol of the droplets ejected.

In particular, according to a calculation that must not be considered as exclusive but merely as one of the possible ways of discovering the volume Vol of the droplets ejected 22 starting from the term ΔEp, the latter is multiplied by a constant term, established a priori and which will be examined in greater detail below.

POSSIBLE VARIANTS STILL WITHIN THE SCOPE OF THE INVENTION

Naturally changes and improvements may be made to the method described up to now, without departing from the scope of the invention.

For example, according to a first variant, the continuous driving cycle, which is at the basis of the method of the invention, may also be conducted in a direction opposite that described before, i.e. by delivering to the ejection actuators 17, in the unit of time, a progressively decreasing quantity of driving energy Ep, in such a way that the printhead 11 to begin with operates in the condition of stable ejection of the droplets, and subsequently enters the condition of non-ejection of the droplets, passing through the zone of unstable ejection of the droplets.

On this subject, it is pointed out that, for simplicity's sake, this description has examined in detail only the first case, that of the driving cycle occurring with an increasing driving energy, it being clear that what is described may also be referred to a driving cycle with decreasing energy.

In addition, on the basis of a second variant, the ejection actuators 17 can also be used for the purpose of maintaining the temperature of the printhead 11 constant in the course of the continuous driving cycle, as an alternative to or in combination whith use of the heat control member 29.

For example, the ejection actuators 17 may be driven during steps which alternate in time either with a first pulse signal arranged for driving the ejection actuators 17 with a driving energy Ep varying progressively in a predetermined way in accordance with the continuous driving cycle described above, or with a second signal, also of pulse type, arranged for maintaining the printhead 11 constantly at the stabilization temperature Ts throughout the course of the continuous driving cycle.

In particular this second signal of driving energy Ep, which alternates with the first, is conditioned by the temperature detected by the sensor 28, and may be made of short pulses, such as not to cause the ink to reach boiling point Again, in relation to a third variant, a first part of the ejection actuators 17 is driven in a progressive and predetermined way in accordance with the continuous driving cycle so that the printhead goes from the condition of non-ejection of the droplets, to the condition of stable ejection of the droplets; whereas a second part, different from the first, of the ejection actuators is arranged for keeping the temperature of the printhead under control while the continuous driving cycle is in progress.

In this case, to advantage, the characteristic 50 may be defined in normalized. form, so that one ejection actuator 17 only is referred to, by dividing the globally delivered quantity of driving energy Ep and the globally delivered quantity of feedback energy Er by the number of ejection actuators 17 belonging respectively to the first and second part.

Further Considerations and Theoretical Analysis of the Method of the Invention The method of the invention will now be further examined and discussed in detail from the aspect of the theory, with the support of mathematical formulae, in order to permit a better understanding of the characteristics of the method and of the theoretical principles upon which it is based.

Firstly, the solution proposed by this method of putting in relation the experimentally detected displacement between the two portions 51 and 53 of the characteristic 50 with the actual volume Vol of the droplets ejected is corroborated and experimentally confirmed in the observation that the two portions 51 and 53, corresponding respectively to the non-ejection step and to that of stable ejection of the droplets 22, both have a substantially linear patten, as shown in the diagram of FIG. 6.

In addition, the correlation, implicit in this method, between the term ΔEp, obtained experimentally via the acquisition of the characteristic 50, and the quantities governing the phenomenon of the ejection of the droplets, may be appreciated to greater effect by closer analysis of operation of the printhead 11 under the normal condition of ejection of the droplets.

In this content it should be remembered first and foremost that the characteristic 50 at a certain point abandons its substantially linear pattern, which it had initially along the portion 51, when, on account of the occurrence of ejection of the droplets, the physical system, located inside the printhead and within which the phenomenon of ejection of the droplets takes place, is subject to a subtraction of energy.

Under the normal condition of operation of the head 11 for ejecting the droplets of ink 22, the ink flows towards the area of the ejection actuators 17, coming from the reserve 13, which is at ambient temperature Ta.

The ink, when it arrives in the vicinity of the silicon substrate 21, brushes against it slowly, first in the rear part facing the reserve 13, and then along the slot 26 and the channels leading to the various chambers 24, thus growing progressively closer to the ejection nozzles 17.

Therefore the ink, along its path towards the ejection actuators 17 and in coming against the substrate 21, heats progressively, subtracting heat from the substrate 21, so that the ink at the time when it finally reaches the ejection actuators 17, has now acquired the same temperature Ts as the substrate 21.

In this way, as already underlined, the ink, when it is ejected towards the outside by the nozzles 16 in the form of a droplet 22, subtracts a certain amount of energy from the physical system in place inside the printhead.

It also follows that the temperature control system, arranged in the printhead 11, is obliged to intervene continuously to compensate for the quantity of heat subtracted by the ejection of the droplets 22, in order to maintain the printhead 11 at the predetermined constant temperature Ts in time.

Quantitatively speaking, the total energy subtracted Et, on account of the ejection of n droplets, is given by:

$$n*(Ts-Ta)*Mg*Cs+n*\frac{1}{2}*Mg*Ug^2=Et=n*Es; \qquad (f1)$$

where:

Ts=predetermined stabilization temperature;

Ta=ambient temperature:

Mg=droplet mass;

Cs=ink specific heat (equal to approx 4186 J/Kg*° C.);

Ug=droplet speed;

n=number of droplets;

Es=energy subtracted by the ejection of a single droplet.

The first term of the formula (f1) defines the thermal energy subtracted with ejection of the droplets, whereas the second term defines the kinetic energy of the droplets ejected.

It should also be noted that, by eliminating the term n from the formula (f1), the energy Es subtracted by each droplet 22 is obtained.

Now, by replacing in (f1) the numerical values which on average are found in reality, it is seen that the second term, being approximately 1,000 times smaller, is negligible with respect to the former.

Therefore, by making the energy Es subtracted by each droplet ejected correspond to the term ΔEp, measured experimentally on the basis of the characteristic 50 and defining the increase in the quantity of driving energy Ep from the non-ejection step to that of ejection of the droplets, assuming equal quantities of feedback energy Er, the following expression linking the volume Vol of the droplet to the term measured ΔEp is reached:

$$Vol = \frac{\Delta E_p}{\Delta T * C_s * P_s}; \quad \text{(f2)}$$

where Ps indicates the specific weight of the ink and ΔT=(Ts−Ta).

The formula (f2) defines in quantitative terms the relationship between the volume Vol and the term ΔEp, and also provides a theoretical confirmation of the opportunity of setting the temperature control system of the printhead 11 so that the latter may be maintained in time at a stable over-temperature value (for example, 25° C.) with respect to the ambient temperature. In this way, in fact, the denominator of the expression (f2) becomes constant, and as a result the volume data is independent of any temperature measurements or values, i.e.:

$$\text{Vol}=K*\Delta E; \quad \text{(f3)}$$

where K is a constant that defines a relation of proportionality of the term ΔEp, expressed in microjoules (μj), with the volume of the droplet, expressed in picolitres (pl).

For example, supposing that ΔT=25° C., and that Cs and Ps refer to an ink with characteristics similar to water, K assumes a value of more or less 10.

Formula (f3) is an extremely simple expression that justifies theoretically the solution, indicated by the method of the invention, of obtaining information about the volume Vol of the droplet 22 starting from the term ΔEp detected through acquisition of the characteristic 50, in particular quite simply by multiplying said term ΔEp by a constant value.

We shall now to proceed to examine the way in which, in application, it is possible to obtain with sufficient precision the value of the term ΔEp to be introduced in the formula (f3) to obtain the volume Vol. In particular the whole examination will be conducted assuming that both the driving energy Ep and the feedback energy Er are delivered in pulse form, that is to say through a succession of pulses, by the control unit 31 arranged for controlling the operation of the printhead 11.

For this purpose, first and foremost, the general formula will be shown below that defines the energy E delivered on each pulse to a generic resistor, constituting for example an ejection actuator 17:

$$E=P_{max}*t_p=R*I^2*t_p; \quad \text{(f4)}$$

where Pmax defines the width of each pulse, i.e. the maximum or peak power with which the resistor is driven in correspondence with each pulse, and corresponds for example, to the value Ppmax indicated in FIG. 4; $t_p$ is the driving time, i.e. the duration of each pulse, and corresponds for example, to the time t1 indicated in FIG. 4; R is the value, normally expressed in Ohm, of the typical resistance of the resistor; and finally I is the current transiting in the resistors.

Formula (f4) clearly demonstrates how the power Pmax is dependant on quantities which are not known a priori, and have values that can only be known with precision through experimental measurements.

In detail, in the formula (f4), only the time $t_p$ is known to perfection, it being determined directly by the microprocessor in the control circuit 31, whereas the actual values of the other two quantities, namely R and I, are not known.

In particular, resistance R is a quantity that depends on the head, and of which the nominal value is definitely known, as this is part of design data, but not the actual value for each single head, as the different heads are subject to a spread due to their manufacturing tolerances.

Furthermore, with regard to the current I, this is given by:

$$I = \frac{V}{R + R_s};$$

where V is the driving voltage, and Rs is the total resistance of the driving components arranged in series to the resistance R, i.e. to the resistor constituting the ejection actuator 17.

Therefore in this case the quantities, unknown or at least not known exactly, that have to be measured by experimental means, in order to determine exactly the current I, are three in number the supply voltage V, the resistance R, and the series resistance Rs represented by the head driving components.

In short, the maximum power Pmax that supplies on each pulse a generic resistor of resistance R is defined by the following formula:

$$P_{\max} = R * \frac{V^2}{(R + R_s)^2}; \quad \text{(f5)}$$

However, as may be easily appreciated on observing the formula (f5), a solution intended for determining the power Pmax, starting from the measurement of the individual quantities constituting it, presents at least potentially significant construction difficulties.

In particular, these difficulties depend on the one hand on the fairly high number of quantities to be measured, and on the other hand are linked to the fact that some of the quantities do not appear as easily measurable experimentally, even assuming the availability in the ink jet printer of specific devices and suitable measuring arrangements.

It is therefore appropriate to put in place a solution permitting to reach an overall and sufficiently precise evaluation of the maximum power Pmax, avoiding a timely measurement of the quantities defining it Only in this way in fact will it be possible to determine both the driving power Pp, and the feedback power Pr, and correspondingly the quantities of driving energy Ep and feedback energy Er defining the experimental characteristic 50, without resorting to an experimental measurement of the different quantities contributing to defining the power values Pp and Pr.

One possible example of a solution will now be described and analyzed, in the assumption that the heat control system, also called "feedback" system and having the task of keeping the temperature inside the printhead 11 constantly under control, is based, as already stated in relation to one variant, on the use of heating elements consisting of a determined number of ejection actuators 17 associated with the nozzles 16, and does not use any other additional heating elements.

In detail, these ejection actuators 17 used by the heat control system alternate a first form of operation, for the purpose of maintaining the printhead 11 at the stabilization temperature Ts, during which the ejection actuators 17 are driven with short pulses, which alone are unable to make the ink reach boiling point; and a second form of operation during which the ejection actuators 17 are driven, again in pulse form but progressively, according to the predefined law of evolution of the continuous driving cycle, in such a way as to gradually activate ejection of the droplets.

Both the driving power Pp and the feedback power Pr delivered at the start and in the course of the continuous driving cycle may be expressed with the following formula:

$$P_{med}=P_{max}*t_p*f; \tag{f6}$$

where Pmed is the average power, referable both to the driving power Pp and to the feedback power Pr, which it is assumed are delivered in a continuous and constant way during a cycle of the respective driving power or feedback power signal;

Pmax is, as already stated, the maximum power, referable both to the driving power and to the feedback power, occurring with each pulse of the respective signal;

tp is, as already defined, the duration of each pulse; and f is the frequency of the pulses forming both the periodic signal of driving power Pp and the periodic signal of feedback power Pr.

It should be observed that the product tp*f defines the time percentage, or duty cycle, for which the signal of driving power Pp or of feedback power Pr is high, i.e. equal to Pmax.

To begin with, the operation of detecting the ambient temperature Ta is effected, and the value of the stabilization temperature Ts of the printhead is set so as to correspond to an increment, or overtemperature, ΔT that is predetermined and constant with respect to the ambient temperature Ta detected.

Subsequently, still in the condition of null delivery of driving energy Ep, the control unit 31 effects all the thermal feedback preliminary setting and activation operations, in order to bring the printhead 11 to and keep stably at the overtemperature ΔT.

The average feedback power Prmed(o) delivered during this starting step, in relation to each ejection actuator 17 used by the thermal feedback, in order to maintain the printhead at the overtemperature ΔT, is accordingly defined by the following formula:

$$P_{rmed(o)}P_{max}*\ t_{p(o)}*f_{(o)}; \tag{f7}$$

where tp(o) and f(o) are respectively the duration of each pulse and the frequency of the pulses of the signal of feedback power Pr, as defined initially by the thermal feedback. Therefore the product tp(o)*f(o) indicates the duty cycle, set by the control unit 31, which is necessary to keep the printhead 11 at the overtemperature ΔT at the beginning.

The terms that are part of the second member of the formula (f7) are all known, with the exception of the power Pmax, as they are defined by the control unit 31 as explained above.

Accordingly the formula (f7) alone, as the value of Pmax is unknown, does not enable us to calculate the value of the average feedback power Prmed(o) in the initial condition of null driving energy Pp and absence of ejection of droplets, when the continuous driving cycle still has to commence.

However it is possible to determine the average starting feedback power Prmed(o) through the following simple relation:

$$P_{rmed(o)} = \frac{\Delta T}{\theta}; \tag{f8}$$

where θ is the thermal resistance of the printhead 11, when it is in conditions of absence of ejection of droplets, and ΔT is the overtemperature with respect to the ambient temperature Ta at which the printhead 11 is maintained by the thermal feedback It is pointed out that (f8) is an equation of the type describing quantitatively the heat exchange phenomenon that takes place in that area of the thermal head intended for being constantly maintained at the overtemperature ΔT.

θ is an item of data that must be considered as known, as it can be obtained with great precision in the laboratory, nor is it subject to potential and significant variations, on account both of the fact that the overtemperature ΔT set is a constant, and that the surfaces of the front part of the printhead concerned in a heat exchange, at the front with the external environment and at the rear with the ink, are not subject to significant manufacturing spreads.

In fact, the manufacturing precision of the printheads is such as not to imply generally significant percentage variations of the dimensions of these exchange surfaces, due also to the fact that these parts are not as small as other parts of the printhead.

To resume, before the continuous driving cycle starts and after the control unit 31 has carried out all the thermal feedback preliminary setting and activation operations, using the formula (f8), the initial feedback power Prmed(o) may be determined with good precision.

Therefore, starting from the average initial feedback power Prmed(o) thus calculated, the power Pmax appearing in the formula (f7) may be obtained, i.e.:

$$P_{\max} = \frac{P_{rmed(o)}}{(t_{p(o)} * f_{(o)})}; \tag{f9}$$

In fact, as already seen, the times that define both duration and frequency of the pulses constituting the signal of feedback power Pr are fully known as they are set or calculated by the control unit 31 governing operation of the printhead 11.

In this way, the value is calculated for the power Pmax which, it will be recalled, refers not only to the feedback power Pr but also to the driving power Pp, since the ejection actuators are provided for being supplied in pulse form either with the driving power Pp, or with the feedback power Pr.

It also follows that, once the value of power Pmax has been acquired, in the diagram of FIG. 6 the starting point P1 or at least the starting zone of the characteristic 50 may be defined, corresponding to the situation where the quantity of driving energy Ep delivered is null or low, and at any rate not sufficient to cause ejection of the droplets 22.

Subsequently, the continuous driving cycle has its course, during which the control unit 31 on the one hand intervenes to automatically adjust the frequency of the short pulses, or, assuming operation is at low frequency, their duration, in such a way as to maintain in time the printhead at the overtemperature ΔT reached to begin with, while on the other hand the same control unit 31 intervenes to power the printhead 31 with progressively increasing quantities of the driving energy Pp so that the printhead 31 moves gradually from the condition of no ejection of droplets to the condition of stable ejection of droplets.

As already stated, these quantities of the energies Ep and Er are made change while the continuous driving cycle is in progress by altering certain parameters of the respective signals, in particular by varying the duration of the pulses constituting the signals of driving power Pp and feedback power Pr.

Now, as the starting point of the characteristic 50 has been defined, the subsequent points of the characteristic 50, corresponding to progressive quantities of the driving energy Ep, are defined with certainty while the continuous driving cycle is in progress.

For example, these subsequent points can be defined with the formula Ep=Pmax*t1, where t1 (FIG. 4) is the progressively varying duration of the pulses of the driving power Pp signal.

In general, the points of the characteristic 50 are defined by progressive values of the parameter, typically the duration or frequency of the pulses, which is made change to progressively increase in a predetermined way the quantity of driving energy Ep, and by the corresponding values of the parameter, for example, the duration of the short pulses, which is made change, in relation to the feedback energy Er, to keep the head at the stabilization temperature Ts set, and therefore at the predefined overtemperature ΔT.

In this way, all the points of the characteristic 50 are defined with certainty and unambiguously, so that the characteristic 50 may be acquired and processed in order to calculate the term ΔEp to be inserted in turn in the formula (3) to determine the volume Vol of the droplets ejected.

Accordingly it is clear how the solution presented above enables to determine as a whole the points of the characteristic (50), and therefore to obtain the term ΔEp to be inserted in the formula (f3) in order to calculate the volume Vol of the droplets, in a precise and reliable way, in particular without the need to make direct measurement of the quantities contributing, individually, to defining the driving energy Ep and the feedback energy Er.

Example of Application of the Method of the Invention for Automatically Setting Printing Modes This method may be used to advantage in various forms in a context of thermal ink jet printing technology, and for example, can support some important and advantageous features, such as for example, that of automatically adjusting the modes governing the printing operations effected by the printer 10, either when printing in black and white or when printing in colour, in order to always obtain optimal printing quality under all conditions.

In fact, starting from the determining of the actual value of the volume of the droplets ejected, the system managing the printer 10 may trace back to the dimensions of the dots printed, and correspondingly give the appropriate information for the printer driver to calibrate optimally the print parameters, particularly the modes of distribution and diffusion, known as "dithering", of the dots printed on the sheet of paper.

The volume or the volumes of the droplets ejected by the thermal ink jet heads, mounted on the printer 10, can, once known, be stored in any known way, so that they are available for the printer driver installed on the computer controlling the printer, when the printer driver requires them.

Figure 7:
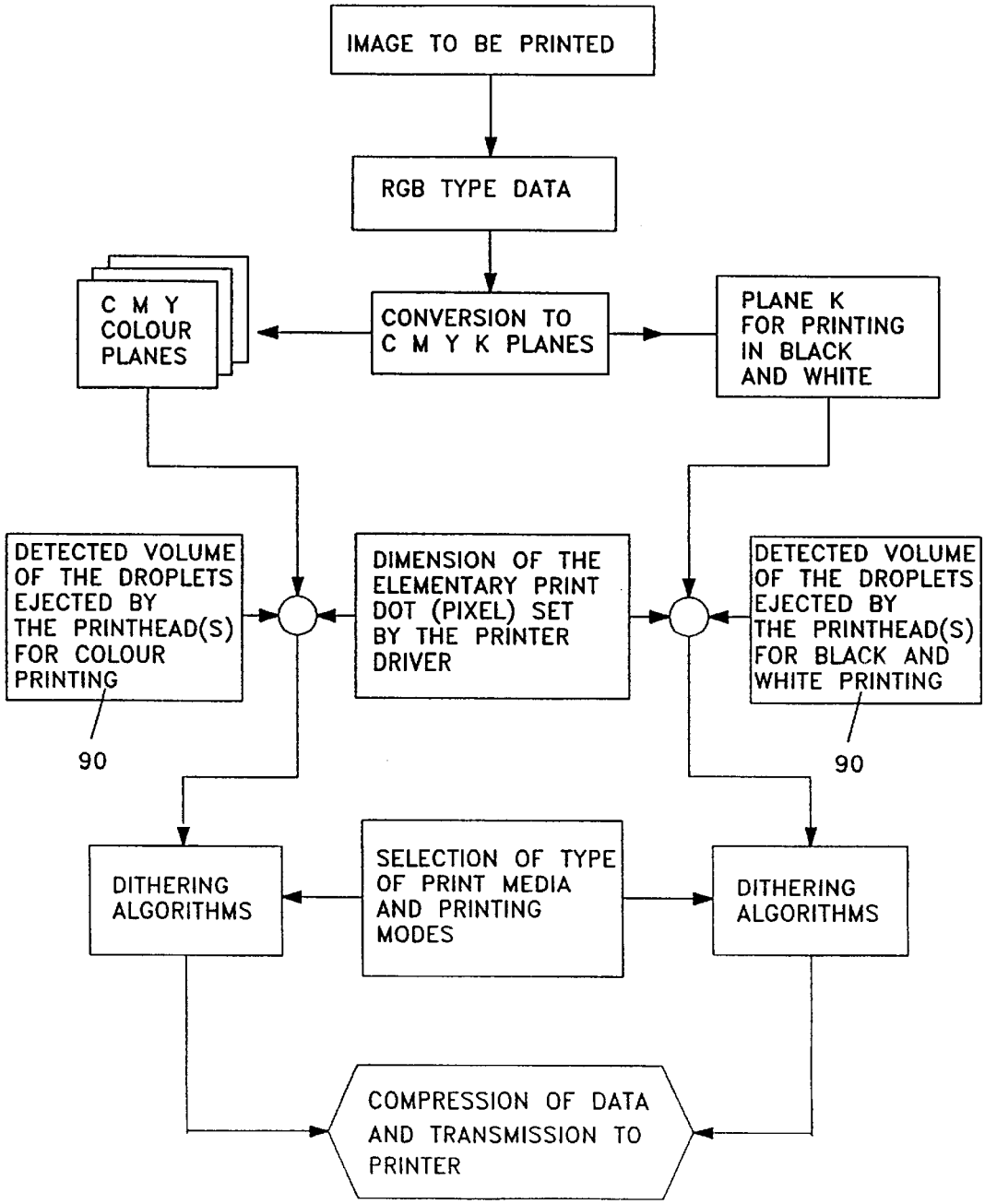
FIG. 7 is a flow chart concerning one example of application of the method of the invention for automatically setting the printing modes in an ink jet printer.

The block diagram of FIG. 7 shows the method of operation of the printer driver for managing printing quality, and in particular for defining completely automatically the best printing settings in an ink jet printer, starting from information 90, obtained using this method, about the volume of the droplets ejected by one or more printheads, whether black and white or colour, fitted in the printer.

It can be seen plainly from this diagram how the information 90 obtained with the method of this invention cooperates with the other information managed by the printer driver to permit better performances in producing black and white and colour printouts of high quality.

In detail, the printer driver determines, in relation to the volume of the droplets ejected, the optimal number of the droplets that may be employed to cover a certain area of the print medium, or to form an elementary dot of the image reproduced on the print medium, taking into account that, as a general rule for optimal printing, the lower the volume of the droplets the greater the number of droplets that must be used, whereas the greater the volume of the droplets, the lower the number of droplets needed for printing.

It is understood that changes and/or improvements may be made to the method for detecting the volume of the droplets ejected by a thermal ink jet printhead, and also to the ink jet printer suitable for implementing the method, described up to this point, without departing from the scope of this invention.

What is claimed is:

1. Method for detecting the volume (Vol) of the droplets (22) of ink ejected by a thermal ink jet printhead (11), said printhead (11) being provided with one or more ejection actuators (17) suitable for activating the ejection of said droplets (22), and further being associated with a heat control system (31, 29, 28; 31, 17) of the feedback type suitable for keeping the temperature inside said printhead (11) under control, comprising the following steps:

subjecting said thermal ink jet printhead (11) to a continuous driving cycle developing from a first condition of absence of ejection of droplets by said printhead (11), to a second condition of stable ejection of droplets, at substantially constant volume, by the printhead (11), wherein during said continuous driving cycle a given number of said ejection actuators (17) are driven with a driving energy (Ep) progressively variable in a predetermined way, while correspondingly said heat control system (31, 29, 28; 31, 17) dissipates in said printhead (11) a feedback energy (Er) suitable to maintain it at a substantially constant stabilization temperature (Ts) despite the variation of said driving energy (Ep);

acquiring a characteristic (50) defining the correlation, during the course of said continuous driving cycle, between the quantities of driving energy (Ep) progressively delivered in a predetermined way to the ejection actuators (17) and the corresponding quantities of feedback energy (Er) dissipated by said heat control system (29) in said printhead (11) to keep it at the stabilization temperature (Ts), and processing in combination a first (51) and a second (53) end portion of said characteristic (50), corresponding respectively to said first condition of absence of ejection of droplets and to said second condition of stable ejection of droplets, in order to obtain information about the actual volume (Vol) of the droplets (22) that are ejected by said printhead (11) in said second condition of stable ejection of droplets.

2. Method according to claim 1, wherein the step of processing in combination is adapted for reciprocally comparing said end portions (51, 53) of said characteristic (50) and comprises in particular the following sub-steps:

detecting a deviation (ΔEp) between said first (51) and said second portion (53) of said characteristic (50), and calculating, on the basis of said deviation (ΔEp), said actual volume (Vol) of the droplets (22) that are ejected stably by said printhead (11).

3. Method according to claim 2, wherein said deviation (ΔEp) is defined by the increase in the quantity of the driving energy (Ep), delivered to the ejection actuators (17), occurring between a first point belonging to the first portion (51) of said characteristic or to the relative prolongation, and a second point belonging to the second portion (53) of said characteristic or to the relative prolongation, wherein said first and said second point are chosen so as to correspond to an identical quantity of the feedback energy (Er) dissipated by said heat control system (31, 28, 29; 31, 17).

4. Method according to claim 2, wherein said calculating step comprises the multiplication of said deviation (ΔEp) by a constant coefficient (K).

5. Method according to claim 1, wherein said driving energy (Ep) and said feedback energy (Er) are delivered through a respective signal having a pulse pattern.

6. Method according to claim 1, wherein said driving energy (Ep) varies in accordance with an increasing direction during said continuous driving cycle, so latter the latter develops from said first condition corresponding to the absence of ejection of droplets, to said second condition corresponding to the stable ejection of droplets.

7. Method according to claim 1 wherein said heat control system (31, 28, 29) comprises a temperature sensor (28) suitable for detecting the temperature of said printhead (11), and at least one heat control member (29) suitable for being retroactively conditioned by said temperature sensor (28) to dissipate in said printhead (11) said feedback energy (Er), so as to maintain said printhead (11) constantly at said stabilization temperature (Ts).

8. Method according to claim 7, wherein said temperature sensor (28) and said heat control member (29) are materially one and the same entity and are made of a resistor integrated in said ink jet printhead (11), wherein said resistor works both to detect the temperature of said printhead (11), and to dissipate in the latter-named said feedback energy (Er).

9. Method according to claim 1, wherein said heat control system (31, 17) comprises, as the heat control member, at least a part of the ejection actuators (17) of said printhead (11).

10. Method according to claim 9, wherein the actuator or the actuators belonging to said heat control system (31, 17) operate alternatively, in the course of said continuous driving cycle, either to dissipate said feedback energy (Er) in said printhead (11), in order to maintain it at said stabilization temperature (Ts), or to receive said driving energy (Ep) progressively varying in a predetermined way.

11. Method according to claim 9, wherein the ejection actuator or actuators (17) belonging to said heat control system (31, 17) are distinct from that or from those that are supplied with said driving energy (Ep) progressively varying in a predetermined way in the course of said continuous driving cycle.

12. Method according to claim 2, further comprising the following steps:

initially detecting the value of the ambient temperature (Ta) present in the surrounding area of the printhead (11), increasing the detected value of the ambient temperature according to a predetermined quantity (ΔT) to obtain an incremented temperature value, setting for said stabilization temperature (Ts) said incremented temperature value, so that the stabilization temperature (Ts) set corresponds to a predetermined overtemperature (ΔT) with respect to the ambient temperature (Ta).

13. Method according to claim 12, wherein, in the course of said continuous driving cycle, a first part of said one or more ejection actuators (17) of said printhead (11) are supplied with said driving energy (Ep) progressively varying in a predetermined way, and a second part of said one or more ejection actuators (17) are supplied, since belonging to said heat control system (31, 17), with said feedback energy (Er) in order to maintain the printhead (11) at the predetermined overtemperature (ΔT), and wherein furthermore both the driving power (Pp) corresponding to said driving energy (Ep) and the feedback power (Pr) corresponding to said feedback energy (Er) are delivered to the ejection actuators (17) via respective periodic signals made of a plurality of pulses, both of said signals being defined, in relation to each ejection actuator (17) used in said continuous driving cycle, by a common formula of the type Pmed=Pmax*tp*f, where Pmed is the average power, referred to both the driving power (Pp) and the feedback power (Pr), which is hypothetically delivered continuously and constantly during said signals, Pmax is the maximum power, referred to both the driving power and the feedback power and having a constant value, which defines the width of each pulse of said signals, tp is the duration of each of the pulses making up said signals, and f is the frequency in time of said pulses, so that the product tp*f corresponds to the percentage of time for which said signals are at maximum power Pmax, the method comprising the following steps:

determining the average initial feedback power Prmed (o) needed to maintain, in the condition of null driving power and therefore also of no ejection of droplets, the printhead (11) at said overtemperature (ΔT) with respect to the ambient temperature (Ta), using a formula of the type Prmed(o)=ΔT/θ, where ΔT is said overtemperature, and θ is a coefficient typical of each model of thermal ink jet head, depending essentially on the properties of thermal conductivity of the area of the thermal ink jet printhead (11) in which the phenomenon of ejection of said droplets (22) takes place, said coefficient θ being preferably predefined by experimental means;

calculating the maximum power Pmax relative to the pulse signal of said feedback power (Pr) through a formula of the type Pmax=Prmed(o)/(tp(o)*f(o)), where Prmed(o) is the average initial feedback power calculated using the previous formula, and tp(o) and f(o) are respectively the duration and frequency of the pulses, determined by the heat control system (31, 17), of the signal of the feedback power (Pr), which are needed to maintain initially the printhead (11) at said overtemperature (ΔT), in the condition of absence of delivery of driving power (Pp), and producing the quantities of driving energy Ep that are delivered in the course of said continuous driving cycle through a formula of the type Ep=Pmax*t1, where Pmax is the power calculated previously, referred as already stated also to the driving power signal, and t1 indicates the duration, varying according to the predetermined law of evolution of the continuous driving cycle, of the pulses of the signal of the driving power (Pp), that is to say in general by combining said maximum power Pmax with the value of one or more temporal parameters (t1) defining the pulses of the signal of said driving power (Pp), so that in this way it is possible to determine globally and with precision all the points of said characteristic (50), for the purpose of detecting said deviation (ΔEp) between said first (51) and said second portion (53) of said characteristic (50), without the need to measure individually the various quantities contributing to defining the quantities of driving energy (Ep) and of feedback energy (Er) delivered to the ejection actuators (17) in the course of said continuous driving cycle.

14. Method according to claim 13, wherein the step of determining said average initial feedback power Prmed(o) comprises the following sub-steps:

S detecting the type of said printhead, and selecting, from a predefined table stored in the system (31) controlling said ink jet printhead (11), a value of said average initial feedback power Prmed(o) corresponding to the type of said printhead (11) detected and to said overtemperature (ΔT).

15. Method for detecting the volume (Vol) of the droplets (22) of ink ejected by a thermal ink jet printhead (11) provided with:

at least one nozzle (16), at least one ejection actuator (17) associated with said nozzle (16) for activating the ejection of said droplets (22), a temperature sensor (28) suitable for detecting the temperature of said printhead (11), and at least one heat control member (29) suitable for being retroactively conditioned by said temperature sensor (28) to keep the temperature of said printhead (11) under control, comprising the following steps:

a continuous driving cycle, during which said thermal actuator (17) is driven with a driving energy (Ep) progressively varying in a predetermined way, whereas said heat control member (29) correspondingly absorbs and dissipates in said printhead (11), depending on the temperature detected by said sensor (28), a feedback energy (Er) suitable for maintaining said printhead (11) at a substantially constant stabilization temperature (Ts) despite the variation of said driving energy (Ep); said driving cycle being comprised by a first step, at low driving energy, which is such as not to cause the ejection of said droplets (22), a second step, at high driving energy, which corresponds to a condition of nominal operation of said printhead (11) and is such as to cause a stable ejection of the droplets (22) of ink at a substantially constant volume, and an intermediate step between said first and said second step, in which the ejection of said droplets (22) occurs unstably and at a variable volume, acquiring a characteristic (50) defining the experimental correlation occurring, during the course of said driving cycle, between the quantities of driving energy (Ep) progressively delivered to said ejection actuator (17) and the corresponding quantities of feedback energy (Er) absorbed by said heat control member (29), said characteristic (50) consisting of a first portion (51) corresponding to said first step at low driving energy and having a substantially linear pattern, a second portion (53) corresponding to said second step at nigh driving energy and also having a substantially linear pattern, and a third portion (52), arranged between said first (51) and said second portion (53), having a curving pattern with roughly the shape of an inflection, detecting a deviation (ΔEp) between said first (51) and said second portion (53) of said characteristic (50), and calculating, on the basis of said deviation (ΔEp), the actual volume (Vol) of the droplets (22) that are ejected stably by said printhead (11) during said second step, that is to say in the condition of nominal operation of said printhead (11).

16. Ink jet printer (10) comprising means (31) suitable for implementing the method according to claim 1 for detecting the volume (Vol) of the droplets (22) of ink ejected by a thermal ink jet printhead (11) fitted in said printer (10).

17. Ink jet printer (10), according to claim 16, which is suitable for working in conformity to a plurality of printing operating modes, and comprises means for automatically setting the printing operating modes depending on the value detected of said volume (Vol).

* * * * *